US007401863B1

(12) United States Patent
Hall et al.

(10) Patent No.: US 7,401,863 B1
(45) Date of Patent: Jul. 22, 2008

(54) PRESS-FIT PICK

(76) Inventors: David R. Hall, 2185 S. Larsen Pkwy., Provo, UT (US) 84606; Ronald Crockett, 2185 S. Larsen Pkwy., Provo, UT (US) 84606; Jeff Jepson, 2185 S. Larsen Pkwy., Provo, UT (US) 84606

( * ) Notice: Subject to any disclaimer, the term of this patent is extended or adjusted under 35 U.S.C. 154(b) by 0 days.

(21) Appl. No.: 11/695,689

(22) Filed: Apr. 3, 2007

Related U.S. Application Data

(63) Continuation of application No. 11/695,672, filed on Apr. 3, 2007, which is a continuation-in-part of application No. 11/686,831, filed on Mar. 15, 2007.

(51) Int. Cl.
*E21C 35/18* (2006.01)

(52) U.S. Cl. ..... 299/95; 299/113

(58) Field of Classification Search ..... 299/111, 299/113, 95

See application file for complete search history.

(56) References Cited

U.S. PATENT DOCUMENTS

| | | | |
|---|---|---|---|
| 2,004,315 | A | 6/1935 | Fean |
| 2,124,438 | A | 7/1938 | Struk |
| 3,254,392 | A | 6/1966 | Novkov |
| 3,746,396 | A | 7/1973 | Radd |
| 3,807,804 | A | 4/1974 | Kniff |
| 3,830,321 | A | 8/1974 | McKenry |
| 3,932,952 | A | 1/1976 | Helton |
| 3,945,681 | A | 3/1976 | White |
| 4,005,914 | A | 2/1977 | Newman |
| 4,006,936 | A | 2/1977 | Crabiel |
| 4,098,362 | A | 7/1978 | Bonnice |
| 4,109,737 | A | 8/1978 | Bovenkerk |
| 4,156,329 | A | 5/1979 | Daniels |
| 4,199,035 | A | 4/1980 | Thompson |
| 4,201,421 | A | 5/1980 | Den Besten |
| 4,277,106 | A | 7/1981 | Sahley |
| 4,439,250 | A | 3/1984 | Acharya |
| 4,465,221 | A | 8/1984 | Acharya |
| 4,484,644 | A | 11/1984 | Cook |
| 4,489,986 | A | 12/1984 | Dziak |
| 4,678,237 | A | 7/1987 | Collin |
| 4,682,987 | A | 7/1987 | Brady |
| 4,688,856 | A | 8/1987 | Elfgen |
| 4,725,098 | A | 2/1988 | Beach |
| 4,729,603 | A | 3/1988 | Elfgen |
| 4,765,686 | A | 8/1988 | Adams |
| 4,765,687 | A | 8/1988 | Parrott |
| 4,776,862 | A | 10/1988 | Wiand |
| 4,880,154 | A | 11/1989 | Tank |
| 4,932,723 | A | 6/1990 | Mills |
| 4,940,288 | A | 7/1990 | Stiffler |
| 4,944,559 | A | 7/1990 | Sionnet |

(Continued)

*Primary Examiner*—John Kreck
(74) *Attorney, Agent, or Firm*—Tyson J. Wilde

(57) ABSTRACT

In one aspect of the invention, a pick comprises a shank attached to a base of a steel body, a cemented metal carbide core press fit into the steel body opposite the shank, and an impact tip bonded to a first end of the core opposite the shank. The impact tip comprises a superhard material opposite the core, and the core comprises a second end and a largest diameter. A distance through the body from the shank to the second end of the core is less than the largest diameter of the core.

19 Claims, 9 Drawing Sheets

U.S. PATENT DOCUMENTS 4,951,762 A 8/1990 Lundell
5,011,515 A 4/1991 Frushour
5,112,165 A 5/1992 Hedlund
5,141,289 A 8/1992 Stiffler
5,154,245 A 10/1992 Waldenstrom
5,186,892 A 2/1993 Pope
5,251,964 A 10/1993 Ojanen
5,332,348 A 7/1994 Lemelson
5,417,475 A 5/1995 Graham
5,447,208 A 9/1995 Lund
5,535,839 A 7/1996 Brady
5,542,993 A 8/1996 Rabinkin
5,653,300 A 8/1997 Lund
5,738,698 A 4/1998 Kapoor
5,823,632 A 10/1998 Burkett
5,837,071 A 11/1998 Anderson
5,845,547 A 12/1998 Sollami
5,875,862 A 3/1999 Jurewicz
5,934,542 A 8/1999 Nakamura
5,935,718 A 8/1999 Demo
5,944,129 A 8/1999 Jensen
5,967,250 A 10/1999 Lund
5,992,405 A 11/1999 Sollami
6,006,846 A 12/1999 Tibbitts
6,019,434 A 2/2000 Emmerich
6,044,920 A 4/2000 Massa
6,051,079 A 4/2000 Andersson
6,056,911 A 5/2000 Griffin
6,065,552 A 5/2000 Scott
6,102,486 A * 8/2000 Briese ..... 299/111
6,113,195 A 9/2000 Mercier
6,170,917 B1 1/2001 Heinrich
6,193,770 B1 2/2001 Sung
6,196,636 B1 3/2001 Mills
6,196,910 B1 3/2001 Johnson
6,199,956 B1 3/2001 Kammerer
6,216,805 B1 4/2001 Lays
6,270,165 B1 8/2001 Peay
6,341,823 B1 1/2002 Sollami
6,354,771 B1 3/2002 Bauschulte
6,364,420 B1 4/2002 Sollami
6,371,567 B1 4/2002 Sollami
6,375,272 B1 4/2002 Ojanen
6,419,278 B1 7/2002 Cunningham
6,478,383 B1 11/2002 Ojanen
6,499,547 B2 12/2002 Scott
6,517,902 B2 2/2003 Drake
6,585,326 B2 7/2003 Sollami
6,685,273 B1 2/2004 Sollami
6,692,083 B2 2/2004 Latham
6,709,065 B2 3/2004 Peay
6,719,074 B2 4/2004 Tsuda
6,733,087 B2 5/2004 Hall
6,739,327 B2 5/2004 Sollami
6,758,530 B2 7/2004 Sollami
6,786,557 B2 9/2004 Montgomery, Jr.
6,824,225 B2 11/2004 Stiffler
6,851,758 B2 2/2005 Beach
6,854,810 B2 2/2005 Montgomery, Jr.
6,861,137 B2 3/2005 Griffin
6,889,890 B2 5/2005 Yamazaki
6,966,611 B1 11/2005 Sollami
6,994,404 B1 2/2006 Sollami
7,204,560 B2 4/2007 Mercier
2002/0175555 A1 11/2002 Mercier
2003/0110667 A1 * 6/2003 Adachi et al. ..... 37/348
2003/0140350 A1 7/2003 Noro
2003/0209366 A1 11/2003 McAlvain
2003/0234280 A1 12/2003 Cadden
2004/0026983 A1 2/2004 McAlvain
2004/0065484 A1 4/2004 McAlvain
2005/0159840 A1 7/2005 Lin
2005/0173966 A1 8/2005 Mouthaan
2006/0237236 A1 10/2006 Sreshta

* cited by examiner

PRESS-FIT PICK

CROSS REFERENCES

This patent application is a continuation of U.S. patent application Ser. No. 11/695,672 filed on Apr. 3, 2007 and entitled Core for a Pick. U.S. patent application Ser. No. 11/695,672 is a continuation-in-part of U.S. patent application Ser. No. 11/686,831 filed on Mar. 15, 2007 and entitled A Superhard Composite Material Bonded to a Steel Body. All of the above mentioned references are herein incorporated by reference in their entirety.

BACKGROUND OF THE INVENTION

Efficient degradation of materials is important to a variety of industries including the asphalt, mining, construction, drilling, and excavation industries. In the asphalt industry, pavement may be degraded using picks, and in the mining industry, picks may be used to break minerals and rocks. Picks may also be used when excavating large amounts of hard materials. In asphalt recycling, a drum supporting an array of picks may rotate such that the picks engage a paved surface causing it to break up. Examples of degradation assemblies from the prior art are disclosed in U.S. Pat. No. 6,824,225 to Stiffler, US Pub. No. 20050173966 to Mouthaan, U.S. Pat. No. 6,692,083 to Latham, U.S. Pat. No. 6,786,557 to Montgomery, Jr., U.S. Pat. No. 3,830,321 to McKenry et al., US. Pub. No. 20030230926, U.S. Pat. No. 4,932,723 to Mills, US Pub. No. 20020175555 to Merceir, U.S. Pat. No. 6,854,810 to Montgomery, Jr., U.S. Pat. No. 6,851,758 to Beach, which are all herein incorporated by reference for all they contain. The picks typically have a tungsten carbide tip, which may last less than a day in hard milling operations. Consequently, many efforts have been made to extend the life of these picks. Examples of such efforts are disclosed in U.S. Pat. No. 4,944,559 to Sionnet et al., U.S. Pat. No. 5,837,071 to Andersson et at, U.S. Pat. No. 5,417,475 to Graham et al., U.S. Pat. No. 6,051,079 to Andersson et al., and U.S. Pat. No. 4,725,098 to Beach, U.S. Pat. No. 6,733,087 to Hall et al., U.S. Pat. No. 4,923,511 to Krizan et al., U.S. Pat. No. 5,174,374 to Hailey, and U.S. Pat. No. 6,868,848 to Boland et al., all of which are herein incorporated by reference for all that they disclose.

BRIEF SUMMARY OF THE INVENTION

In one aspect of the invention, a pick comprises a shank attached to a base of a steel body, a cemented metal carbide core press fit into the steel body opposite the shank, and an impact tip bonded to a first end of the core opposite the shank. The impact tip comprises a superhard material opposite the core, and the core comprises a second end and a largest diameter. A distance through the body from the shank to the second end of the core is less than the largest diameter of the core. The shank, carbide core and superhard material may be generally coaxial. The press fit may comprise an interference of between 1 and 5 thousandths of an inch proximate the second end of the core.

The largest diameter of the core may be between 0.25 and 2 inch. The cemented metal carbide core may comprise a volume of 0.250 cubic inches to 6.00 cubic inches. The cemented metal carbide core and the impact tip may be brazed together with a braze material comprising a melting temperature from 700 to 1200 degrees Celsius. An impact surface of the impact tip may comprise a conical geometry, semispherical geometry, domed geometry, flat geometry, or combinations thereof.

The superhard material may comprise diamond, polycrystalline diamond, cubic boron nitride, refractory metal bonded diamond, silicon bonded diamond, layered diamond, infiltrated diamond, thermally stable diamond, natural diamond, vapor deposited diamond, physically deposited diamond, diamond impregnated matrix, diamond impregnated carbide, cemented metal carbide, chromium, titanium, aluminum, tungsten, or combinations thereof.

The steel body may comprise a tapered portion. A least a portion of the steel body may comprise a generally frustoconical geometry when manufactured or when in use. The steel body may be stepped. The steel body may comprise a wear resistant material disposed on at least a portion of an otherwise exposed surface of the body.

The steel body may comprise a volume of 0.5 cubic inches to 25 cubic inches. The shank may comprise a coating of wear resistant material. A reentrant may be formed at the intersection of the shank and the base of the steel body. The shank may be secured within a holder attached to a milling drum connected to the underside of a pavement milling machine. The shank may be secured to a bit body adapted for subterranean drilling, coal mining, or a trenching machine.

In another aspect of the invention, a pick comprises a shank attached to a base of a steel body. The steel body comprises a base diameter encompassing a rear steel volume proximate the shank, and a forward steel volume proximate to the rear volume opposite the shank that is encompassed by at least one diameter smaller than the base diameter. A carbide core is press fit into the steel body opposite the shank and is bonded to an impact tip comprising a superhard material opposite the core. The core comprises a forward core volume and a rear core volume respectively proximate the forward and rear steel volumes. A ratio of the forward core volume to the forward steel volume is less than 3.5 times a ratio of the rear core volume to the rear steel volume.

In another aspect of the invention, a pick comprises a shank attached to a base of a steel body. A core harder than the steel is press fit into the steel body opposite the shank. An impact tip is bonded to a first end of the core opposite the shank and comprises a superhard material opposite the core. A second end of the core is press fit deeper into the steel body than a width of the core.

In one aspect of the invention, a high impact resistant tool has a superhard material bonded to a cemented metal carbide substrate at a non-planar interface. At the interface, the substrate has a tapered surface starting from a cylindrical rim of the substrate and ending at an elevated flatted central region formed in the substrate. The superhard material has a pointed geometry with a sharp apex having 0.050 to 0.125 inch radius. The superhard material also has a 0.100 to 0.500 inch thickness from the apex to the flatted central region of the substrate. In other embodiments, the substrate may have a non-planar interface. The interface may comprise a slight convex geometry or a portion of the substrate may be slightly concave at the interface. A volume of the superhard material may be 75 to 150 percent of a volume of the carbide substrate. In some embodiments, the volume of diamond may be up to twice as much as the volume of the carbide substrate. The substantially pointed geometry may comprise a side which forms a 35 to 55 degree angle with a central axis of the tool. The angle may be substantially 45 degrees. The substantially pointed geometry may comprise a convex and/or a concave side. In some embodiments, the radius may be 0.090 to 0.110 inches. Also in some embodiments, the thickness from the apex to the non-planar interface may be 0.125 to 0.275 inches. The substrate may comprise a height of 2 to 6 mm.

DETAILED DESCRIPTION OF THE INVENTION AND THE PREFERRED EMBODIMENT

Figure 1:
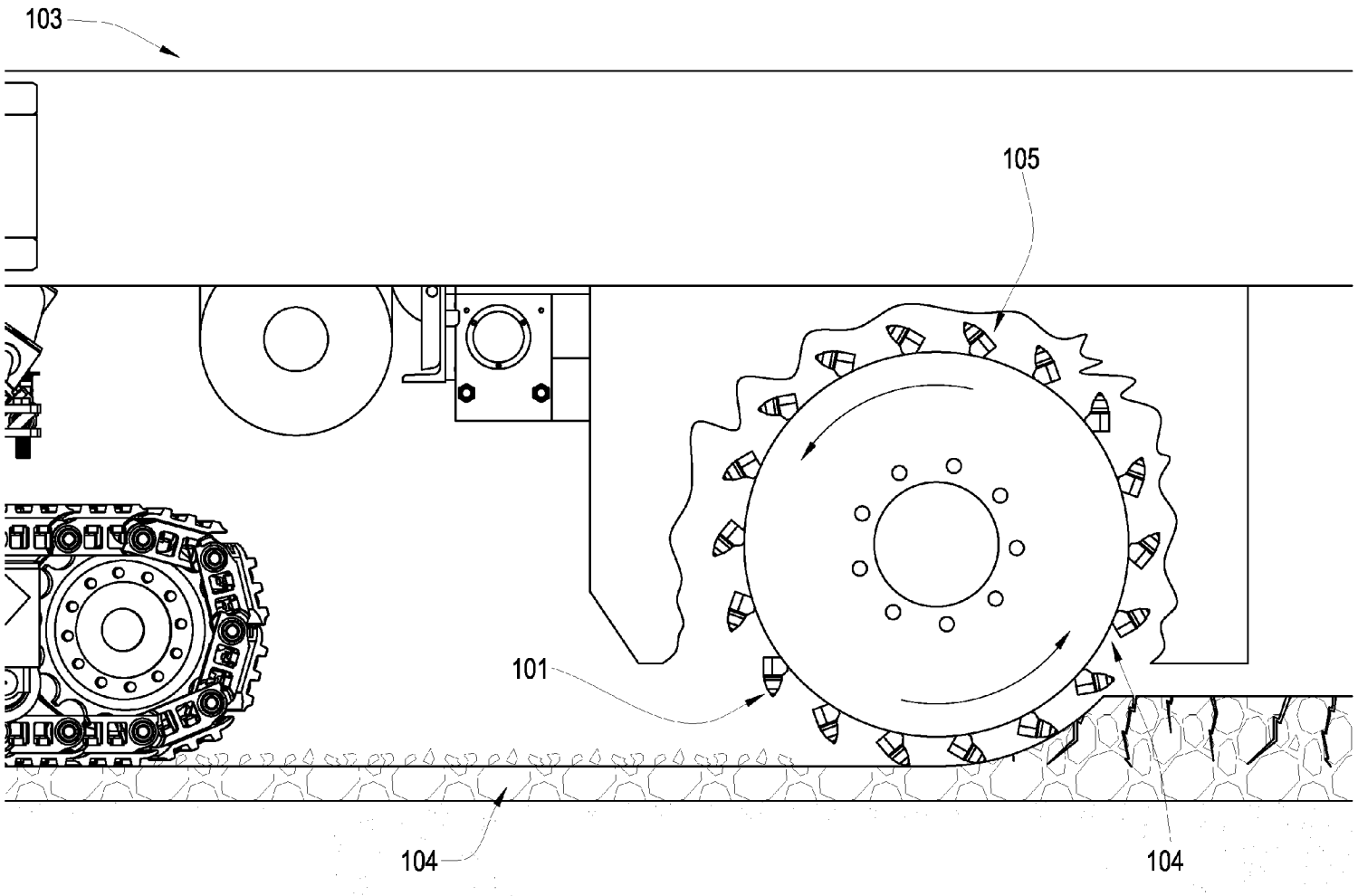
FIG. 1 is a cross-sectional diagram of an embodiment of a plurality of picks on a rotating drum attached to a motor vehicle.

FIG. 1 is a cross-sectional diagram of an embodiment of a plurality of picks 101 attached to a rotating drum 102 connected to the underside of a pavement recycling machine 103. The recycling machine 103 may be a cold planer used to degrade man-made formations such as pavement 104 prior to the placement of a new layer of pavement. Picks 101 may be attached to the drum 102 bringing the picks 101 into engagement with the formation. A holder 105 or block is attached to the rotating drum 102, and the pick 101 is inserted into the holder 105. The holder 105 or block may hold the pick 101 at an angle offset from the direction of rotation, such that the pick 101 engages the pavement at a preferential angle.

Figure 2:
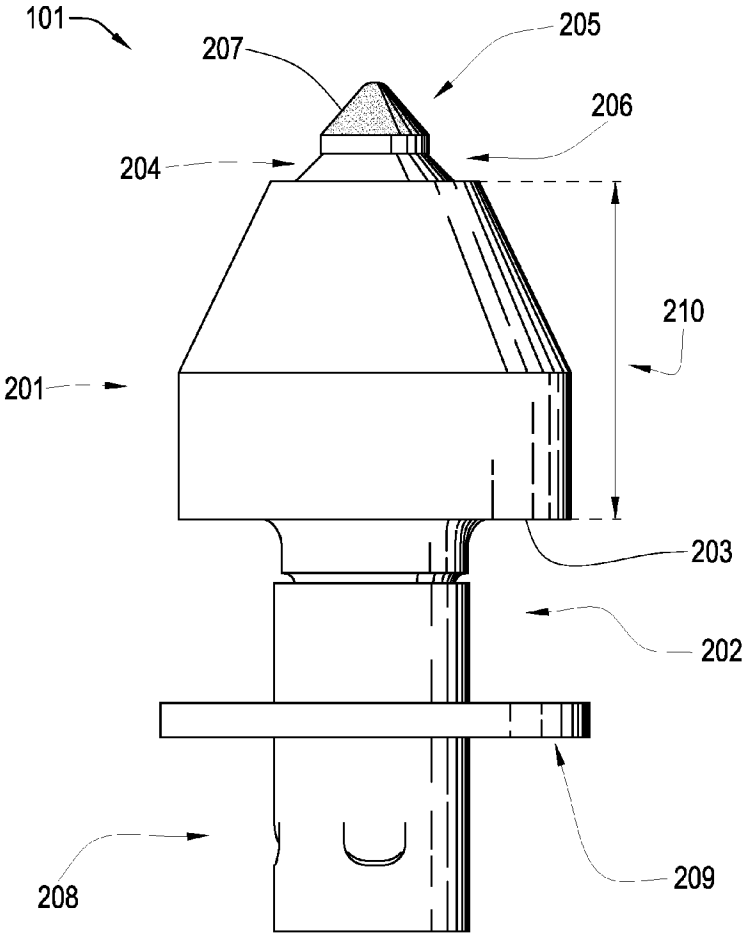
FIG. 2 is an orthogonal diagram of an embodiment of a pick.

FIG. 2 is an orthogonal diagram of an embodiment of a pick 101. The pick 101 comprises a steel body 201 attached to a shank 202 at a steel base 203 of the body 201. The steel body 201 may comprise steel selected from the group consisting of 4140, ENB10, S7, S5, A2, tool steel, hardened steel, alloy steels, PM M-4, T-15, M-4, M-2, D-7, D-2, Vertex, PM A-11, A-10, A-6, O-6, O-1, H-13, EN30B, and combinations thereof. A cemented metal carbide core 204 is press fit into the steel body 201 opposite the shank 202. The steel body 201 may comprise a length 210 from a distal end to the steel base 203. In some embodiments of the invention the carbide core 204 may be press fit into at least 65% of the length 210 of the steel body 201. An impact tip 205 is bonded to a first end 206 of the core 204 opposite the shank 202. The impact tip 205 comprises a superhard material 207 opposite the core 204.

The superhard material 207 may comprise diamond, polycrystalline diamond with a binder concentration of 1 to 40 weight percent, cubic boron nitride, refractory metal bonded diamond, silicon bonded diamond, layered diamond, infiltrated diamond, thermally stable diamond, natural diamond, vapor deposited diamond, physically deposited diamond, diamond impregnated matrix, diamond impregnated carbide, monolithic diamond, polished diamond, course diamond, fine diamond, nonmetal catalyzed diamond, cemented metal carbide, chromium, titanium, aluminum, tungsten, or combinations thereof. The superhard material 207 may be a polycrystalline structure with an average grain size of 10 to 100 microns. Picks 101 often rotate within their holders 105 or blocks upon impact with the pavement which allows wear to occur evenly around the pick 101. The impact tip 205 may be angled to cause the pick 101 to rotate within the bore of the holder 105. A protective spring sleeve 208 may be disposed around the shank 202 both for protection and to allow the high impact resistant pick 101 to be press fit into a holder 105 while still allowing the pick to rotate. A washer 209 may also be disposed around the shank 202 such that when the pick 101 is inserted into the holder 105, the washer 209 protects an upper surface of the holder 105 and in some cases facilitates rotation of the pick 101.

Figure 3:
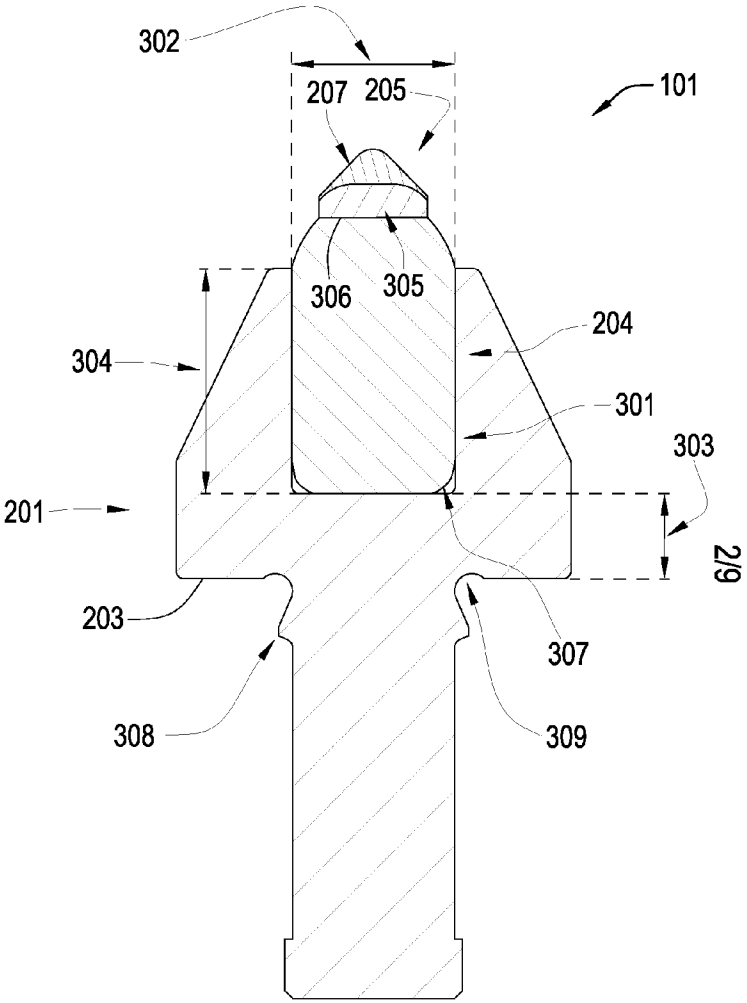
FIG. 3 is a cross-sectional diagram of an embodiment of a pick.

Referring now to FIG. 3, the core 204 of the pick 101 comprises a second end 301 and a diameter 302. Once the core 204 is press fit into the body 201, a distance 303 through the body from the shank 202 to the second end 301 of the core 204 is less than the diameter 302. The diameter 302 may be between 0.25 and 2 inch. It is believed that by press fitting the core 204 into the body 201 such that the second end 301 is closer to the shank 202 than the width of the diameter 302 of the core 204, that the ratio of core diameter 302 to press fit depth 304 is optimized for wear life of the pick 101. At least a portion of the body 201 may comprise a generally frustoconical geometry when manufactured or when in use.

The superhard material 207 may be at least 4,000 HK and in some embodiments it may be 1 to 20000 microns thick. In embodiments, where the superhard material is a ceramic, the material may comprise a region, preferably near its surface, that is free of binder material. Infiltrated diamond is typical made by sintering the superhard material 207 adjacent a cemented metal carbide substrate 305 and allowing a metal (such as cobalt) to infiltrate into the superhard material 207. As disclosed in FIG. 3 the impact tip 205 may comprise a carbide substrate 305 bonded to the superhard material 207. In some embodiments the impact tip 205 may be connected to the core 204 before the core is press fit into the body 201. Typically the substrate of the impact tip 205 is brazed to the core 204 at a planar interface 306. The tip 205 and the core 204 may be brazed together with a braze comprising a melting temperature from 700 to 1200 degrees Celsius.

The superhard material 207 may be bonded to the carbide substrate 305 through a high temperature high pressure process. During high temperature high pressure (HTHP) processing, some of the cobalt may infiltrate into the superhard material such that the substrate 305 comprises a slightly lower cobalt concentration than before the HTHP process. The superhard material 207 may preferably comprise a 1 to 5 percent cobalt concentration by weight after the cobalt or other binder infiltrates the superhard material 207. The superhard material 207 may also comprise a 1 to 5 percent concentration of tantalum by weight. Other binders that may be used with the present invention include iron, cobalt, nickel, silicon, carbonates, hydroxide, hydride, hydrate, phosphorus-oxide, phosphoric acid, carbonate, lanthanide, actinide, phosphate hydrate, hydrogen phosphate, phosphorus carbonate, alkali metals, ruthenium, rhodium, niobium, palladium, chromium, molybdenum, manganese, tantalum or combinations thereof.

In some embodiments, the binder is added directly to the superhard material's mixture before the HTHP processing and do not rely on the binder migrating from the substrate into the mixture during the HTHP processing.

The superhard material 207 may comprise a substantially pointed geometry with a sharp apex comprising a radius of 0.050 to 0.200 inches. In some embodiments, the radius is 0.090 to 0.110 inches. It is believed that the apex may be adapted to distribute impact forces, which may help to prevent the superhard material 207 from chipping or breaking. The superhard material 207 may comprise a thickness of 0.100 to 0.500 inches from the apex to the interface with the substrate 305, preferably from 0.125 to 0.275 inches. The superhard material 207 and the substrate 305 may comprise a total thickness of 0.200 to 0.700 inches from the apex to the core 204. The sharp apex may allow the high impact resistant pick 101 to more easily cleave asphalt, rock, or other formations.

A radius 307 on the second end 301 of the core 204 may comprise a smaller diameter than the largest diameter 302. A reentrant 308 may be formed on the shank 202 near and/or at an intersection 309 of the shank 202 and the base 203 of the body 201. It is believed that placing the reentrant 308 near the intersection 309 may relieve strain on the intersection 309 caused by impact forces.

Figure 4:
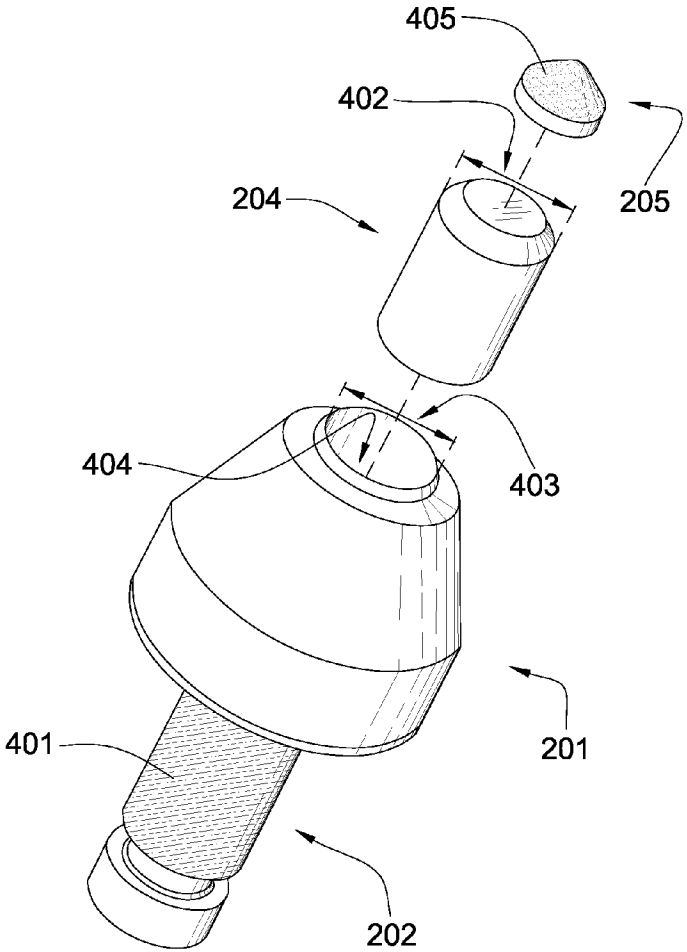
FIG. 4 is an exploded diagram of an embodiment of a pick.

Referring now to FIG. 4, the shank 202 may be coated with a hard surface 401. The hard surface 401 may comprise a cemented metal carbide, chromium, manganese, nickel, titanium, silicon, hard surfacing, diamond, cubic boron nitride, polycrystalline diamond, diamond impregnated carbide, diamond impregnated matrix, silicon bonded diamond, deposited diamond, aluminum oxide, zircon, silicon carbide, whisker reinforced ceramics, nitride, stellite, or combinations thereof. The hard surface 401 may be bonded to the shank 202 though the processes of electroplating, cladding, electroless plating, thermal spraying, annealing, hard facing, applying high pressure, hot dipping, brazing, or combinations thereof. The hard surface 401 may comprise a thickness of 0.001 to 0.200 inches. The hard surface 401 may be polished.

The carbide core 204 may be press fit into the steel body 201 with an interference of between 1 and 5 thousandths of an inch. A base diameter 402 of the core 204 may be between 1 and 5 thousandths of an inch larger than a cavity diameter 403 of a cavity 404 in the steel body 201 into which the core 204 is press fit.

An impact surface 405 of the impact tip 205 may comprise a conical geometry, semispherical geometry, domed geometry, flat geometry, or combinations thereof. The impact tip 205 may comprise a generally circular shape, a generally annular shape, a generally spherical shape, a generally pyramidal shape, a generally conical shape, a generally arcuate shape, a generally asymmetric shape, or combinations thereof.

Figure 5:
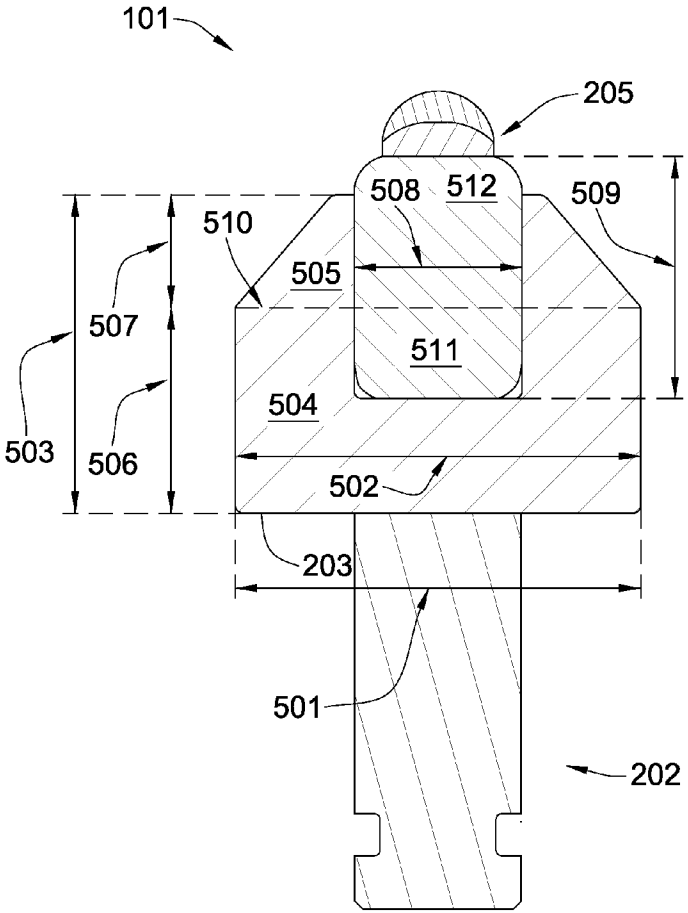
FIG. 5 is a cross-sectional diagram of another embodiment of a pick.

Referring now to FIG. 5, a cross-sectional diagram discloses an embodiment of the invention in which a ratio of forward core volume 512 to forward steel body volume 505 is less than 3.5 times a ratio of rear core volume 511 to rear steel body volume 504. The steel body 201 comprises a base diameter 501, and a total body volume determined by a variable body diameter 502 along a body length 503. The steel body may comprise a total body volume of 0.5 inches to 25 cubic inches. The total body volume comprises a rear body volume 504 proximate the shank 202 and a forward body volume 505 proximate the rear volume 504 and opposite the shank 202. The forward body volume 505 encompasses at least one variable body diameter 502 that is smaller than the base diameter 501. A boundary 510 between the forward and rear body volumes 505, 504 may be disposed at the first variable body diameter 502 that is smaller than the base diameter 501 in the direction moving from the shank 202 towards the impact tip 205 in embodiments where the shank 202, carbide core 204, and superhard material 207 are generally coaxial. The rear body volume 504 may be disposed within a rear volume distance 506 from the steel base 203 of the body 201. The forward body volume may be disposed in a forward volume distance 507 between the rear volume distance 506 and a distal end of the total body length 503. A carbide core 204 is press fit into the steel body 201 opposite the shank 202 and is bonded to an impact tip 205. The impact tip 205 comprises a superhard material 207 opposite the core 204. The core 204 comprises a total volume determined by a variable core diameter 508 along a total core length 509. The core 204 may comprise a total volume of 0.250 cubic inches to 6.00 cubic inches. The core 204 comprises a rear core volume 511 determined by the amount of the total core volume disposed within the rear volume distance 506 from the steel base 203. The core 204 also comprises a forward core volume 512 determined by the amount of the total core volume disposed within the forward volume distance 507. The rear and forward core volumes 511, 512 are respectively proximate the rear and forward steel volumes 504, 505. A ratio of the forward core volume 512 divided by forward steel volume 505 is less than 3.5 times a ratio of the rear core volume 511 divided by rear steel volume 504. The relationship of these ratios is believed to press fit the core 204 into a sufficient press fit depth 304 and into a sufficient amount of steel body 201 in order to optimize the wear life of the pick 101. In some embodiments of the invention the pick 101 may comprise a ratio of total core volume to total steel body volume of between 12 and 35%.

Figure 6:
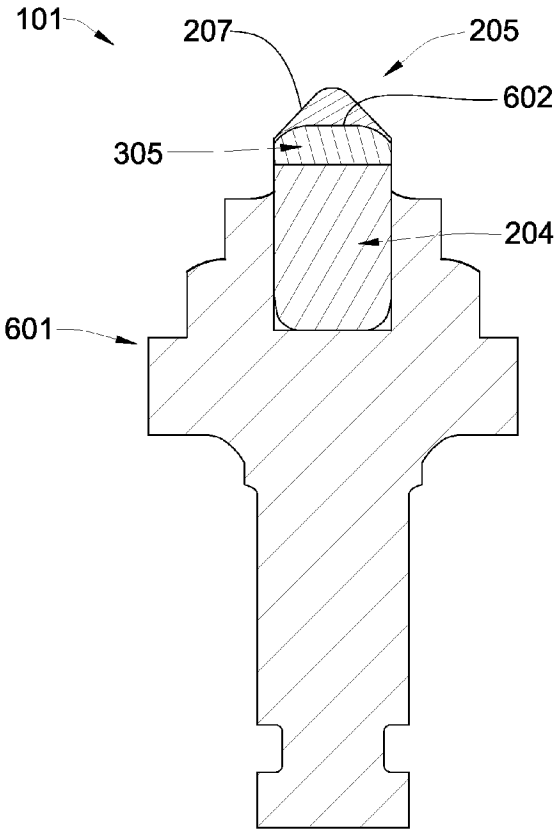
FIG. 6 is a cross-sectional diagram of another embodiment of a pick.

In FIG. 6 an embodiment of the invention is disclosed in which the pick 101 comprises a stepped steel body 601. It is believed that in some applications a stepped body 601 may help to maximize the amount of steel surrounding the press fit core 204 without maximizing the bulkiness of the body 201. FIG. 6 also discloses a generally non-planar interface 602 between the carbide substrate 305 and the superhard material 207 on the impact tip 205.

Figure 7:
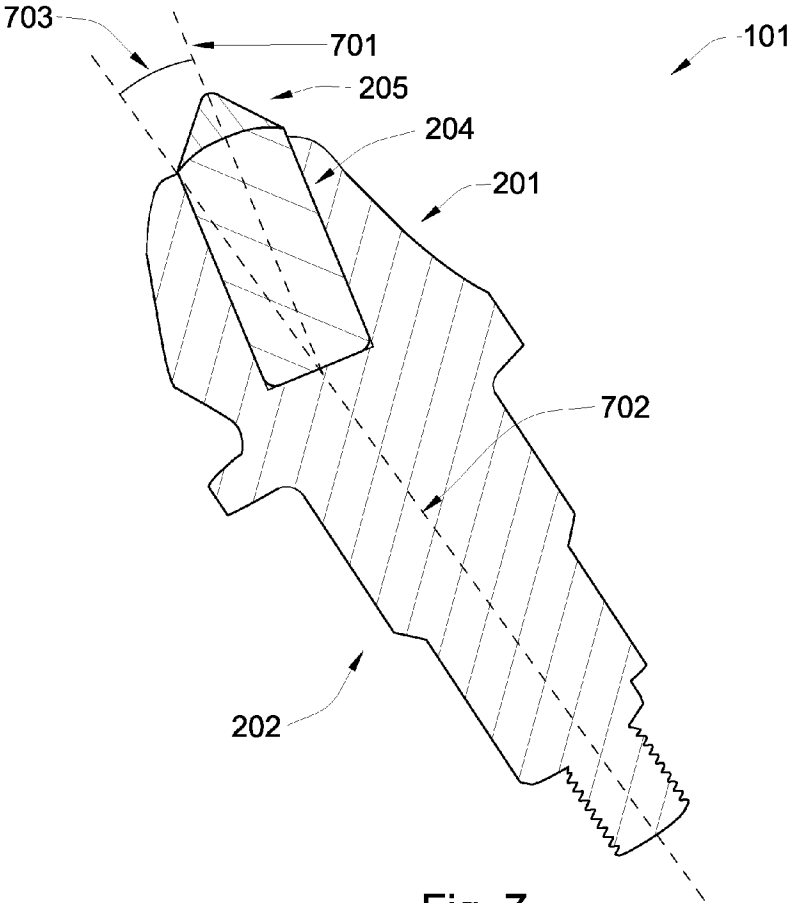
FIG. 7 is a cross-sectional diagram of another embodiment of a pick.

Referring now to FIG. 7, an embodiment of the invention is shown in which the central axes of the carbide core 204 and the steel body 201 are not coaxial. In the present embodiment an acute intermediate angle 703 is shown between the two axes 701, 702. The intermediate angle 703 may be acute, obtuse, or perpendicular. Although in the present embodiment the impact tip 205 is coaxial with the carbide core 204, in some embodiments of the invention the impact tip 205 may not be coaxial with the core 204.

Figure 10:
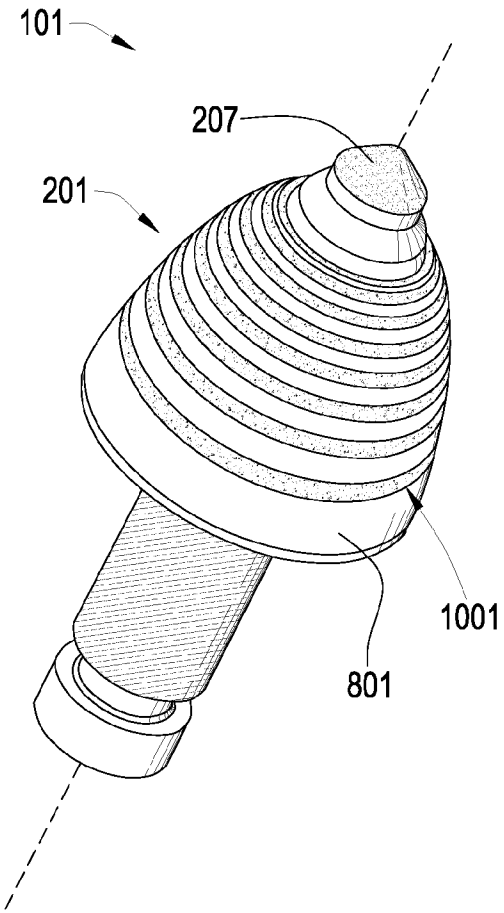
FIG. 10 is a perspective diagram of an embodiment of a pick.
Figure 9:
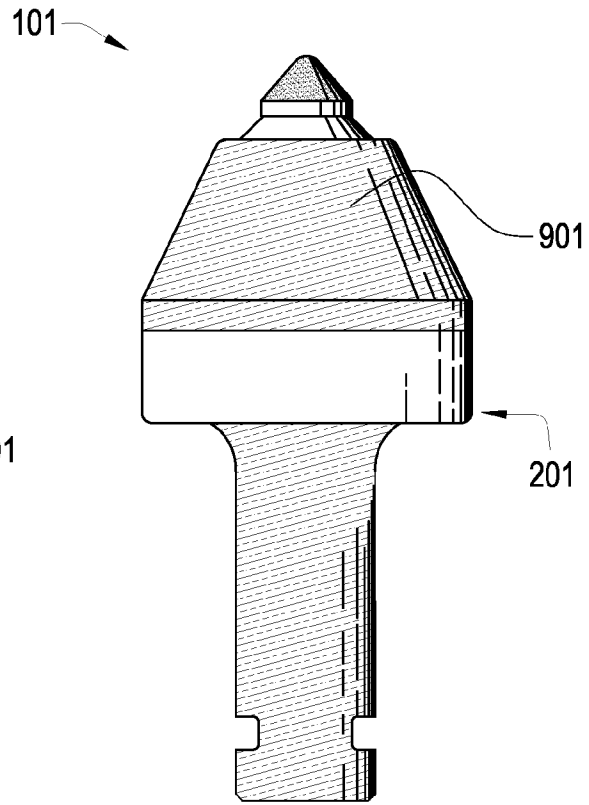
FIG. 9 is an orthogonal diagram of another embodiment of a pick.
Figure 8:
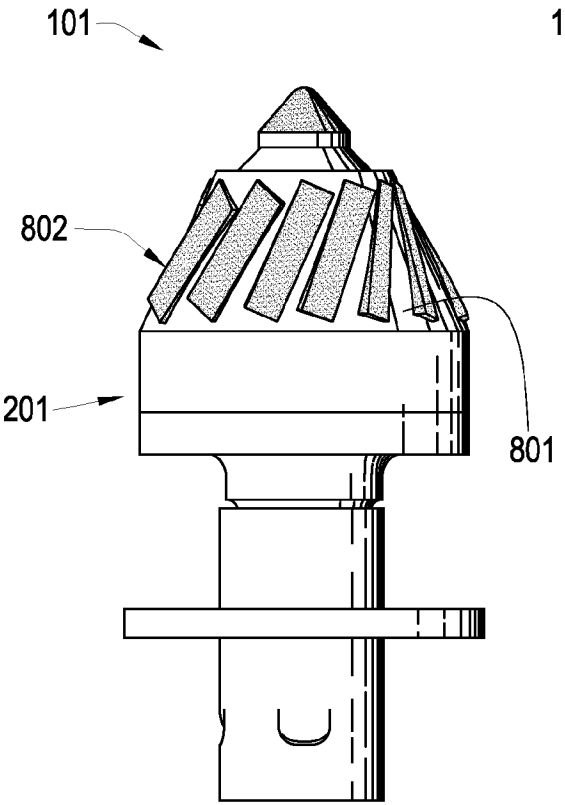
FIG. 8 is an orthogonal diagram of another embodiment of a pick.

FIGS. 8 through 10 disclose embodiments of picks 101 in which at least part of an exposed surface 801 of the steel body 201 comprises a wear resistant material. The present invention may be compatible for attaching a wear resistant material to the steel body 201 through a heating process. Heating may alter the bond between the diamond and carbide substrate leaving residual stresses. The stresses may be avoided by press fitting the core into the steel body subsequent the heating process.

Referring now to FIG. 8, the pick 101 comprises wear resistant inserts 802 on the exposed surface 801 of the steel body 201. The inserts may comprise a cemented metal carbide, hardened steel, diamond, metal, or combinations thereof. Referring now to FIG. 9, a wear resistant coating 901 may be disposed on the exposed surface 801 of the steel body 201. The coating may comprise a hard material selected from the group consisting of cemented metal carbide, chromium, manganese, nickel, titanium, silicon, hard surfacing, diamond, cubic boron nitride, polycrystalline diamond, diamond impregnated carbide, diamond impregnated matrix, silicon bonded diamond, deposited diamond, aluminum oxide, zircon, silicon carbide, whisker reinforced ceramics, nitride, stellite, or combinations thereof. The coating 901 may be bonded to the exposed surface 801 though the processes of electroplating, cladding, electroless plating, thermal spraying, annealing, hard facing, applying high pressure, hot dipping, brazing, or combinations thereof. The coating 901 may comprise a thickness of 0.001 to 0.200 inches.

Referring now to FIG. 10, a pick 101 is shown in which a composite material 1001 is disposed in concentric annular deposits on the exposed surface 801 of the steel body 201 to protect the body 201 from wear. The composite material 1001 may comprise a plurality of diamond, diamond-like and/or cubic boron nitride particles held within a matrix. The matrix may comprise 40 to 80 percent diamond or cubic boron nitride particles by volume. It is believed that that too low of a particle concentration causes the matrix around the particles to wear away thereby causing more of the particles to be exposed and thereby fall out, which in turn exposes new particles. Preferably there is a high enough concentration of the particles that the particles protect the matrix from wearing away and effectively form a super wear resistant composite material. The particles may comprise an average particle size of between 1 and 3500 microns. More preferably, the average particle size is less than 50 microns. Most preferably, the average particle size is less than 10 microns. It is believed the smaller the particle size the greater wear resistance that the composite material will have and thereby protect the steel from wear.

The matrix material may be a metal or a resin bonded. Metal bonded particles may be bonded by a matrix comprising of silver, copper, silicon, indium, nickel, manganese, palladium, zinc, cobalt, titanium, tin, gold, boron, chromium, germanium, aluminum, iron, gallium, vanadium, phosphorus, molybdenum, platinum, alloys, mixtures and combinations thereof. In some embodiments, the superhard particles may be coated with a metal, such as titanium, niobium, cobalt, tantalum, nickel, iron or combinations thereof, which may adhere better to the particles to the matrix. The particles may be bonded by melting the matrix material to a temperature sufficient to melt the matrix but still below the melting temperature of the steel. A metal bonded matrix may comprise a melting temperature from 700 to 1200 degrees Celsius. A heat sink may be placed over at least part of the superhard material 207 or other part of the pick 101 during the heating stage. Water or other fluid may be circulated around the heat sink to remove the heat. The heat sink may also be used to apply a force on the pick 101 to hold it together while brazing.

In some embodiments of the invention the composite material 1001 may comprise resin bonded particles. These particles may be bonded by a resin selected from the group consisting of polyepoxides, plastics, thermosetting resins, epoxies, polymers, epichlorohydrin, bisphenol A, polyimide, and combinations thereof. The resin may be hardened by adding an activating compound, thereby inducing a chemical reaction, such as a polymerization reaction.

Figure 11:
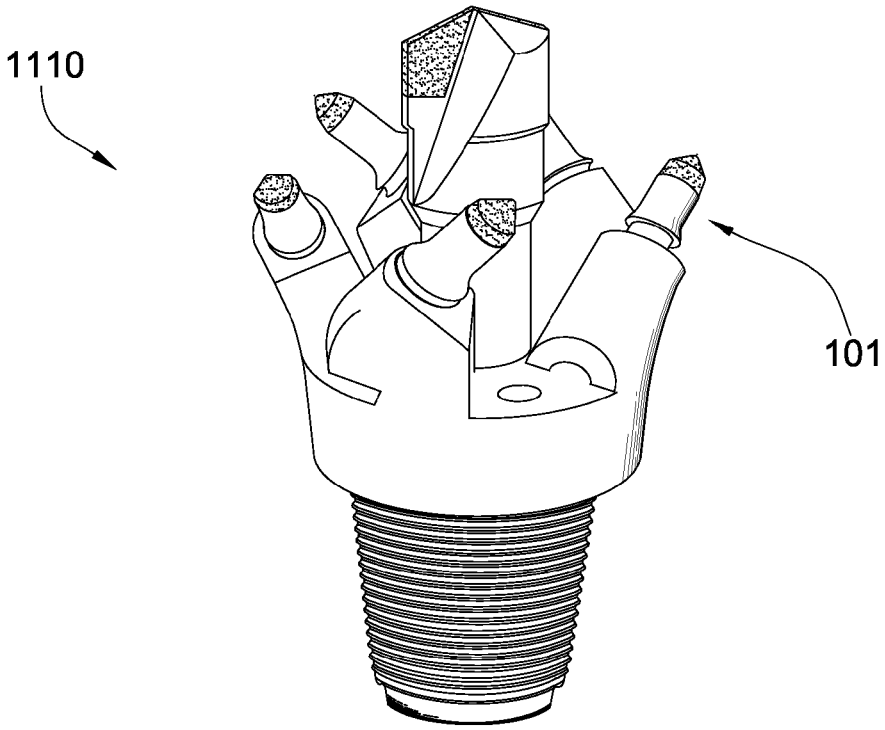
FIG. 11 is an orthogonal diagram of an embodiment of a drill bit.
Figure 12:
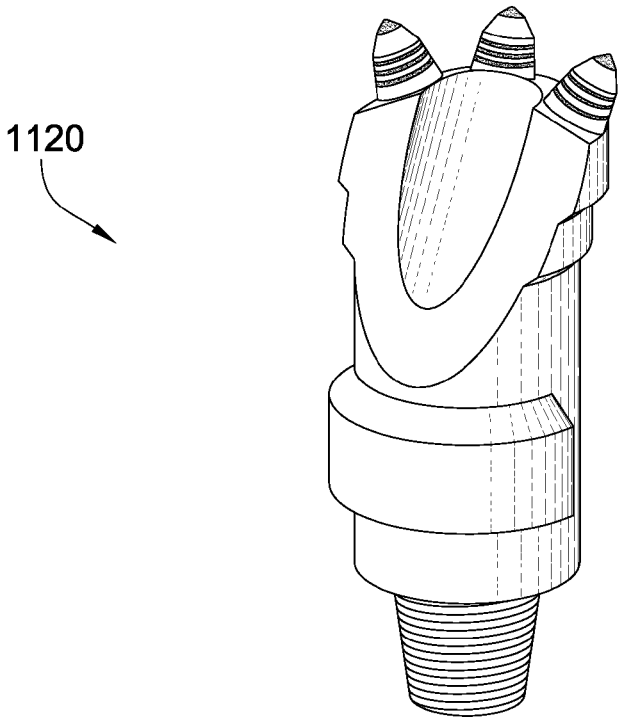
FIG. 12 is an orthogonal diagram of another embodiment of a drill bit.
Figure 13:
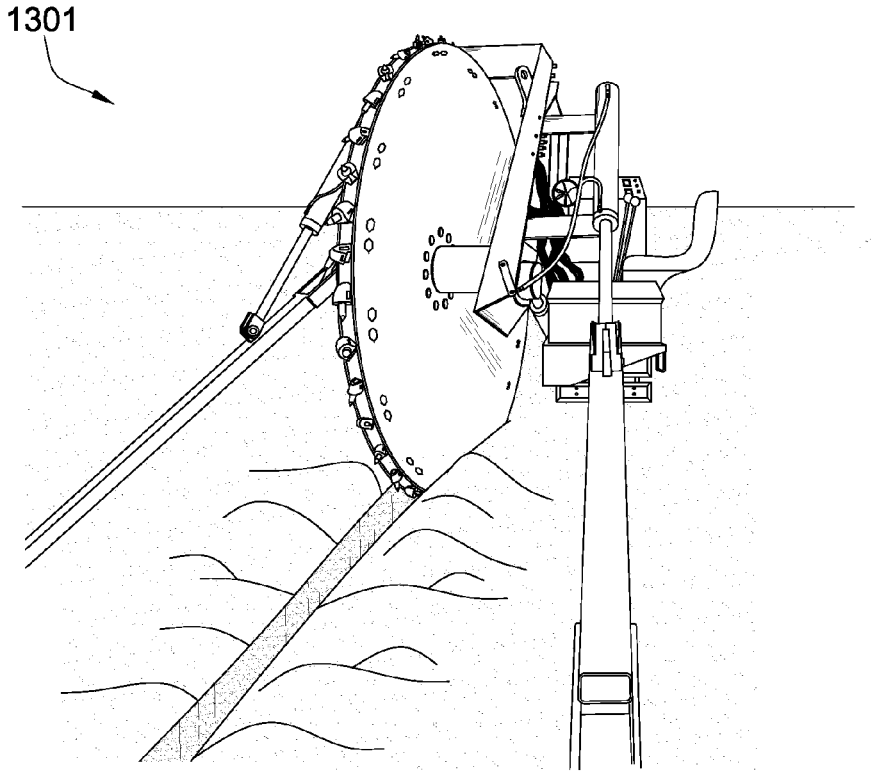
FIG. 13 is a perspective diagram of an embodiment of a trencher.
Figure 14:
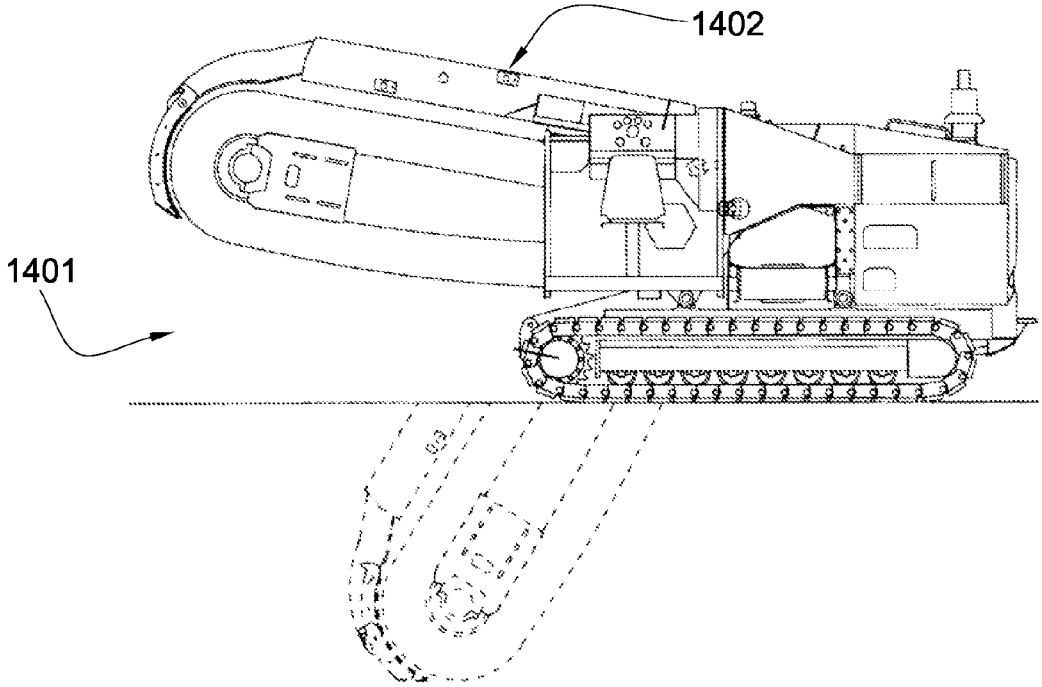
FIG. 14 is an orthogonal diagram of another embodiment of a trencher.

Picks 101 may be used in various applications. The pick 101 may be disposed in an asphalt milling machine 103, as in the embodiment of FIG. 1. FIGS. 11 through 14 disclose various wear applications that may be incorporated with the present invention. FIG. 11 discloses a drill bit 1110 typically used in water well drilling. FIG. 12 discloses a drill bit 1120 typically used in subterranean, horizontal drilling. These bits 1110, 1120, and other bits, may be consistent with the present invention. The pick 101 may be used in a trenching machine, as disclosed in FIGS. 13 through 14. Picks 101 may be disposed on a rock wheel trenching machine 1301 as disclosed in FIG. 13. Referring to FIG. 14, the picks 101 may be placed on a chain that rotates around an arm 1402 of a chain trenching machine 1401. Other applications that involve intense wear of machinery may also be benefited by incorporation of the present invention. Milling machines, for example, may experience wear as they are used to reduce the size of material such as rocks, grain, trash, natural resources, chalk, wood, tires, metal, cars, tables, couches, coal, minerals, chemicals, or other natural resources. Various mills that may incorporate the composite material include mulchers, vertical shaft mills, hammermills, cone crushers, chisels, jaw crushers, or combinations thereof. Percussion bits, roller cone bits, and shear bits used in the oil and gas industry may also incorporate the composite material.

Figure 15:
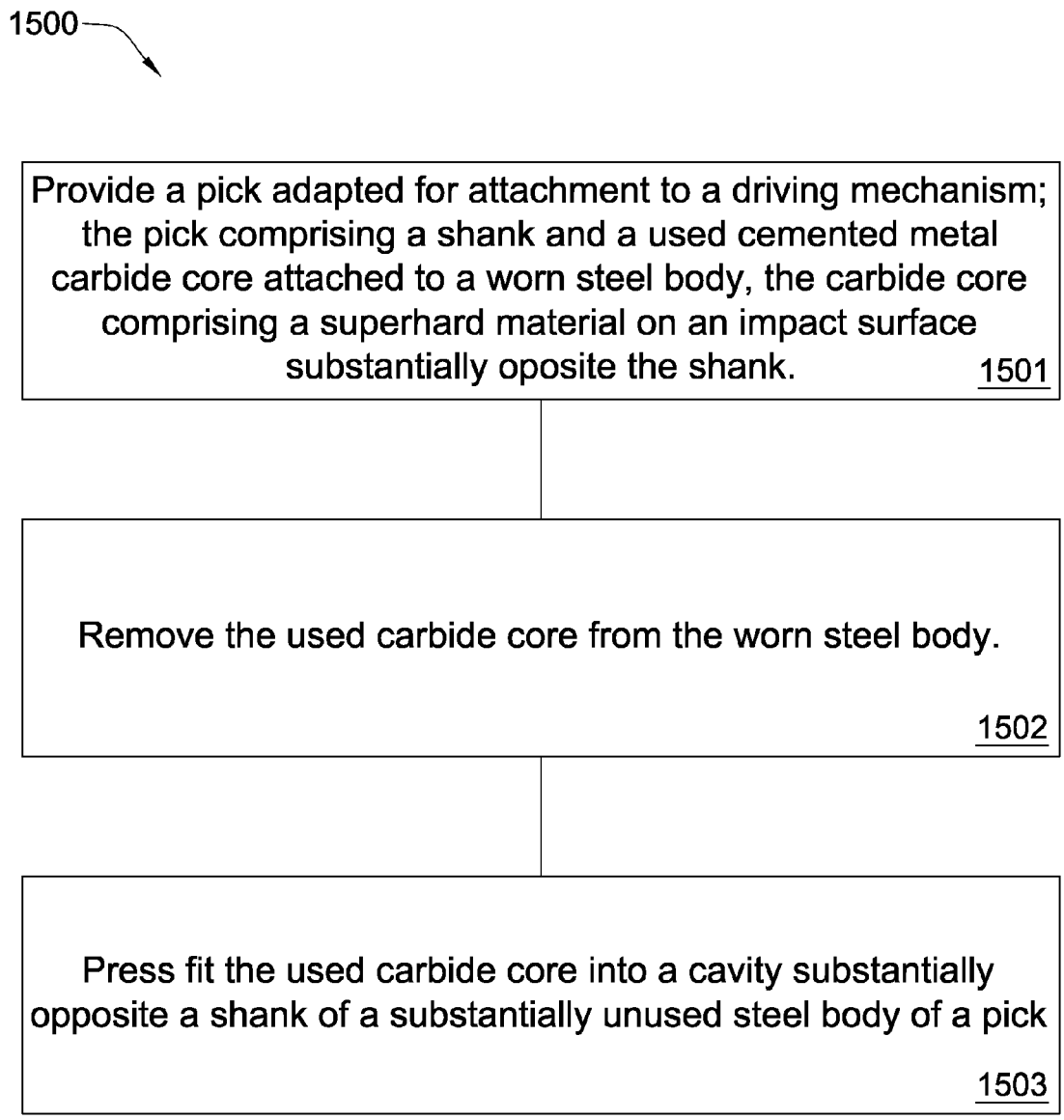
FIG. 15 is a flowchart illustrating an embodiment of a method for providing cost effective picks.

Referring now to FIG. 15, a method 1500 of providing a cost effective pick is disclosed in the form of a flowchart. The method 1500 comprises a step 1501 of providing a pick 101 adapted for attachment to a driving mechanism. The driving mechanism may be a milling drum connected to a pavement milling machine. The pick 101 comprises a shank 202 and a used cemented metal carbide core 204 attached to a worn steel body 201. The carbide core 204 may be press fit to a depth 304 of at least 65% of a length 210 of the worn or unused steel body 201. The carbide core 204 may be press fit to a depth of the steel body such that a distance 303 from the shank 202 to the second end 301 of the carbide core 204 is less than the diameter 302 of the core 204. The carbide core 204 comprises a superhard material 207 on an impact surface substantially opposite the shank. In some embodiments of the invention step 1501 may comprise retrieving a rented pick from a second party. The method 1500 further comprises a step 1502 of removing the used carbide core 204 from the worn steel body 201. The carbide core 204 may be removed by cutting or grinding away portions of the steel body 201 of the provided pick 101. The method 1500 further comprises a step 1503 of press fitting the used carbide core 204 into a cavity 404 substantially opposite a shank of a substantially unused steel body 201 of a pick 101.

The shank 202 may be adapted to be secured to a bit body adapted for subterranean drilling, or to a trenching machine. In some embodiments of the invention a wear resistant washer 209 may be disposed around the shank 202 proximate the steel body 201. In some embodiments of the invention the method 1500 may comprise a step of selling the pick 101 with an incentive given for eventual return of the used core 204 or body 201.

Figure 16:
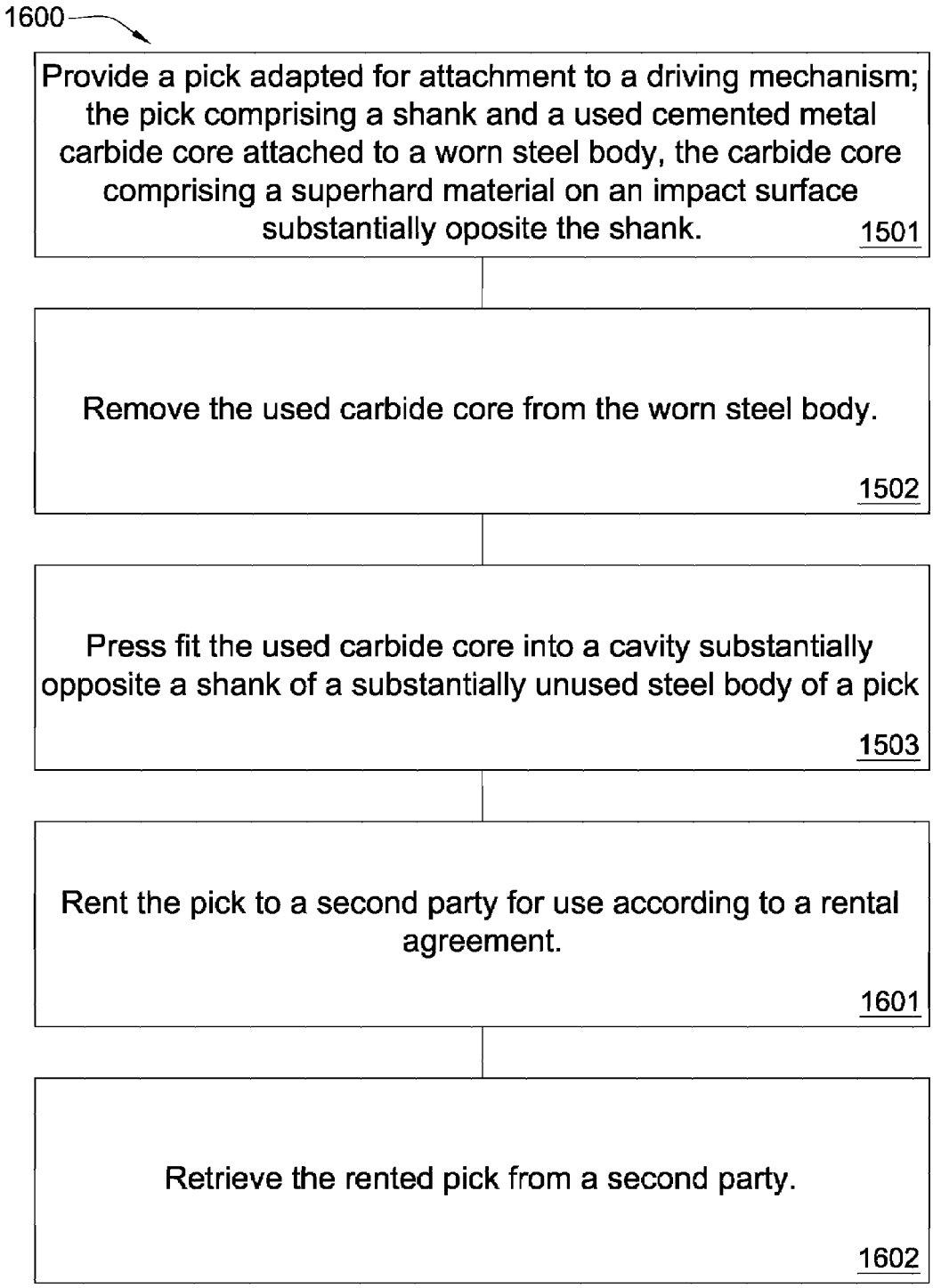
FIG. 16 is a flowchart illustrating another embodiment of a method for providing cost effective picks.

Referring row to FIG. 16, a method 1600 of providing a cost effective pick 101 is disclosed in the form of a flowchart. The method 1600 comprises steps 1501, 1502 and 1503 as detailed in the description of FIG. 15. The method 1600 further comprises a step 1601 of renting the pick 101 to a second party for use according to a rental agreement and a step 1602 of retrieving the rented pick from the second party according to the terms of the agreement. The second party may be charged for the amount of time that they possess or use the pick 101, for the volume, weight, area, or amount of material milled with the pick 101, or for the distance or area of material milled with the pick 101. In some embodiments of the invention the second party may be charged for the profit or revenue generated with the picks 101.

Whereas the present invention has been described in particular relation to the drawings attached hereto, it should be understood that other and further modifications apart from those shown or suggested herein, may be made within the scope and spirit of the present invention.

What is claimed is:

1. A method for providing cost effective picks, comprising:

providing a pick adapted for attachment to a driving mechanism;

the pick comprising a shank and a used cemented metal carbide core attached to a worn steel body, the carbide core comprising a tip with a carbide substrate and a diamond material attached to a working surface, the substrate comprising a thickness less than 6 mm;

removing the used carbide core from the worn steel body; and attaching the used carbide core into a cavity substantially opposite a shank of a steel body of a pick.

2. The method of claim 1, wherein the step of attaching the used carbide core includes press fitting.

3. The method of claim 1, wherein the step of attached the used carbide core includes brazeing.

4. The method of claim 1, wherein the carbide core is attached to a depth of at least 65% of a total depth of the worn or unused steel body.

5. The method of claim 1, wherein the carbide core is attached to a depth of the steel body such that a distance from the shank to a second end of the carbide core is less than a primary diameter of the carbide core.

6. The method of claim 1, wherein the carbide core is attached into the steel body such that a ratio of forward volumes of the core to the body is less than 3.5 times a ratio of rear volumes of the core to the body.

7. The method of claim 1, further comprising a step of renting the pick to a second party for use according to a rental agreement.

8. The method of claim 7, wherein the second party is charged for the amount of time they posses the pick.

9. The method of claim 7, wherein the second party is charged for the volume or area of material they mill with the pick.

10. The method of claim 7, wherein the second party is charged for the distance of material that they mill with the pick.

11. The method of claim 7, wherein the second party is charged for the weight of the material that they mill with the pick.

12. The method of claim 1, wherein the step of providing a pick comprises retrieving a rented pick from a second party.

13. The method of claim 1, further comprising a step of selling the pick with an incentive given for return of the used pick along with the core.

14. The method of claim 1, wherein the carbide core is removed by cutting or grinding away the steel body of the provided pick.

15. The method of claim 1, wherein the shank of the provided pick comprises a reentrant.

16. The method of claim 1, wherein the pick comprises a wear resistant washer disposed around the shank proximate the steel body.

17. The method of claim 1, wherein the driving mechanism is a milling drum connected to a pavement milling machine.

18. The method of claim 1, wherein the shank is adapted to be secured to a bit body adapted for subterranean drilling.

19. The method of claim 1, wherein the shank is adapted to be secured to a trenching machine.

* * * * *